United States Patent [19]

Suzuki et al.

[11] Patent Number: 4,550,701

[45] Date of Patent: Nov. 5, 1985

[54] AIR-FUEL RATIO CONTROL IN AN INTERNAL COMBUSTION ENGINE

[75] Inventors: Atsushi Suzuki; Masakazu Ninomiya, both of Kariya; Katsuya Maeda, Obu; Yutaka Kawashima, Okazaki, all of Japan

[73] Assignee: Nippondenso Co., Ltd., Kariya, Japan

[21] Appl. No.: 597,098

[22] Filed: Apr. 5, 1984

[30] Foreign Application Priority Data

Apr. 8, 1983 [JP] Japan ..... 58-62669

[51] Int. Cl.[4] ..... F02D 37/02

[52] U.S. Cl. ..... 123/436; 123/478

[58] Field of Search ..... 123/416, 417, 436, 478, 123/419, 440, 489

[56] References Cited

U.S. PATENT DOCUMENTS 2,842,108 7/1958 Sanders .
3,596,643 8/1971 Schweitzer .
4,026,251 5/1977 Schweitzer et al. .
4,138,979 2/1979 Taplin .
4,305,364 12/1981 Stuckas .
4,306,284 12/1981 Malcolm ..... 123/416 X
4,403,584 9/1983 Suzuki et al. ..... 123/417
4,442,815 4/1984 Ninomiya ..... 123/436
4,455,981 6/1984 Suzuki et al. ..... 123/436 X
4,467,765 8/1984 Suzuki et al. ..... 123/417 X

FOREIGN PATENT DOCUMENTS 46045 3/1982 Japan .

*Primary Examiner*—Tony M. Argenbright
*Attorney, Agent, or Firm*—Cushman, Darby & Cushman

[57] ABSTRACT

A method for controlling the air-fuel ratio in an internal combustion engine in which the correction of the air-fuel ratio is carried out on the basis of the determination as to whether the base air-fuel ratio is the value in the richer or the leaner side of the air-fuel ratio corresponding to the best specific fuel consumption. A different number of operation points for detecting the signals of the parameters of the engine running state are selected for the automatic constant speed control state and for the non-automatic speed control state.

8 Claims, 10 Drawing Figures

Fig. 4

MAP STORED IN MEMORY

| P \ N | --- | --- | r-2 | r-1 | r | r+1 | r+2 | --- | --- |
|---|---|---|---|---|---|---|---|---|---|
| --- | | | | | | | | | |
| --- | | | | | | | | | |
| p-1 | | | T(p-1,r-2) | T(p-1,r-1) | T(p-1, r ) | T(p-1,r+1) | T(p-1,r+2) | | |
| p | | | T(p,r-2) | T(p,r-1) | T( p , r) | T(p,r+1) | T(p,r+2) | | |
| p+1 | | | T(p+1,r-2) | T(p+1,r-1) | T(p+1, r ) | T(p+1,r+1) | T(p+1,r+2) | | |
| --- | | | | | | | | | |
| --- | | | | | | | | | |

AIR-FUEL RATIO CONTROL IN AN INTERNAL COMBUSTION ENGINE

BACKGROUND OF THE INVENTION

1. Field of the Invention

The present invention relates to a method and an apparatus for controlling the air-fuel ratio in an internal combustion engine.

2. Description of the Prior Art

In general, the air-fuel ratio in an internal combustion engine of a motor car is selected to be equal to or less than the stoichiometrical air-fuel ratio in the ordinary running state; to be equal to the value, approximately 13, corresponding to the maximum output of the engine in the accelerating state with a wide open throttle and in the slope ascending running state; and to be equal to the value chosen from the viewpoint of the stability of the engine in the idling state.

In the prior art, for air-fuel ratio control in the ordinary running state, an open loop control of the carburetor is used in which some loss occurs in the specific fuel consumption due to production line variations in the structure of the engine, the long term variation in the operational characteristic of an engine, and to production line variations in the structure of the carburetor. In an electronically controlled fuel injection device, in which the volume of the intake air is measured by an intake air volume sensor and the like, the required amount of fuel is calculated by a computer device, and the fuel is injected into the air intake manifold by a solenoid valve in accordance with the calculated required amount, a closed loop control is used in which the direction of the stoichiometrical air-fuel ratio (approximately 15) is determined by an oxygen concentration sensor in the exhaust duct. Also, closed loop control of the carburetor, in which the amount of air to be bled is modified in accordance with the determination of the direction of the stoichiometrical air-fuel ratio by the oxygen concentration sensor, is used for some engines. Although these closed loop control systems can reduce variations in the air-fuel ratio, they are disadvantageous in that fuel consumption becomes higher because the theoretical air-fuel ratio is not the correct air-fuel ratio for the best specific fuel consumption.

It is known that, in order to prevent the above described fuel consumption loss from occurring and to attain the optimum specific fuel consumption, a constant altering (so-called "dithering") of the flow rate of the air which by-passes the carburetor is carried out, i.e., the air-fuel ratio is varied at predetermined periods between the rich and lean sides alternately. In this way the direction of the air-fuel ratio which gives the best improvement of the specific fuel consumption is determined, and the air-fuel ratio is then corrected by the subsidiary air valve which by-passes the carburetor. In this method, the engine running is effected once in an air-fuel ratio at the relatively richer side level and once in another air-fuel ratio at the relatively leaner side level, and the rotation rate $N_{er}$ obtained by running under the richer side air-fuel ratio and the rotation rate $N_{el}$ obtained by running under the leaner side air-fuel ratio are compared. The control of the engine is carried out in such a manner that, if $N_{er}>N_{el}$, the amount of by-pass air is decreased, while if $N_{er}<N_{el}$, the amount of by-pass air is increased. (For example, as disclosed in Japanese Unexamined Patent Publication (Kokai) No. 57-46045.)

In the prior art, the number of operation points for detecting the signals for the running states, such as the engine rotational speed, engine torque, or related states, was selected as at least three, and the correction of the air-fuel ratio carried out by changing the required amount of fuel.

In the prior art, in order to attain a precise separation between the engine rotational speed change due to the accelerator pedal actuation by the driver, changes in road conditions, and the like, and that due to the constant altering of the air-fuel ratio for optimum control, that is the change of the air-fuel ratio alternately to the rich side and to the lean side at a predetermined period, it is desirable to increase the number of operation points for detecting the signals for the running states. However, if the number of operation points is increased, the opportunities for correcting the air-fuel ratio are correspondingly reduced, leading to an unavoidable deterioration in the specific fuel consumption.

SUMMARY OF THE INVENTION

The primary object of the present invention is to provide an improved method for controlling the air-fuel ratio in an internal combustion engine, in which the number of operation points for running state detection is selected as corresponding to the change between the automatic constant runnning speed control state and the non-automatic running speed control state, so that the specific fuel consumption in an internal combustion engine is improved.

In accordance with an aspect of the present invention, there is provided a method for controlling the air-fuel ratio in an internal combustion engine, which comprises the steps of: changing the amount of air supplied through a by-pass air supply path which by-passes the main air supply path to realize at least two different values of the air-fuel ratio in the vicinity of a base air-fuel ratio; running the engine with the above realized different values of the air-fuel ratio; detecting at plural operation points the signals of the parameters of the engine running state, such as engine rotational speed, engine torque, and the like, under the running of the engine with the above realized different values of the air-fuel ratio; deciding whether the base air-fuel ratio is in the rich or in the lean side of the air-fuel ratio for the optimum specific fuel consumption by comparing the signals detected at the plural operation points; and correcting the air-fuel ratio on the basis of the result of the decision; a different number of operation points for detecting the signals of the parameters of the engine running state being selected for the automatic constant speed control state and for the non-automatic speed control state.

In accordance with another aspect of the present invention, there is provided an apparatus for controlling the air-fuel ratio in an internal combustion engine, including a unit for varying the air-fuel ratio by varying the amount of fuel injected by the fuel injection valve; sensor units for detecting signals representing the parameters of the engine running state; a unit for regulating the rate of the air flow in a by-pass for a main air path of the engine, the by-pass supplying an air flow to a point downstream of a throttle valve; a unit for switching the engine running state between automatic constant speed control and non-automatic speed control; and a computer for receiving the signals from the sensors, controlling the selection of the air-fuel ratio at the rich and the lean side of the base air-fuel ratio, comparing signals representing richer and leaner engine running states, determining the state of the air-fuel ratio, and producing the signals used for regulating the amount of the fuel injection and the rate of the air flow in the by-pass for the main air path; a different number of operation points for detecting signals representing the parameters of the engine running state being selected for the automatic constant speed control state and for the non-automatic speed control state.

BRIEF DESCRIPTION OF THE DRAWINGS

FIGS. 3, 3A, 3B, and 3C are flow charts which illustrate an example of the calculation process in the computer in the apparatus of FIG. 1A, FIG. 4 illustrates a map stored in the memory in the computer regarding the correction pulse width.

DESCRIPTION OF THE PREFERRED EMBODIMENTS

Figure 1A:
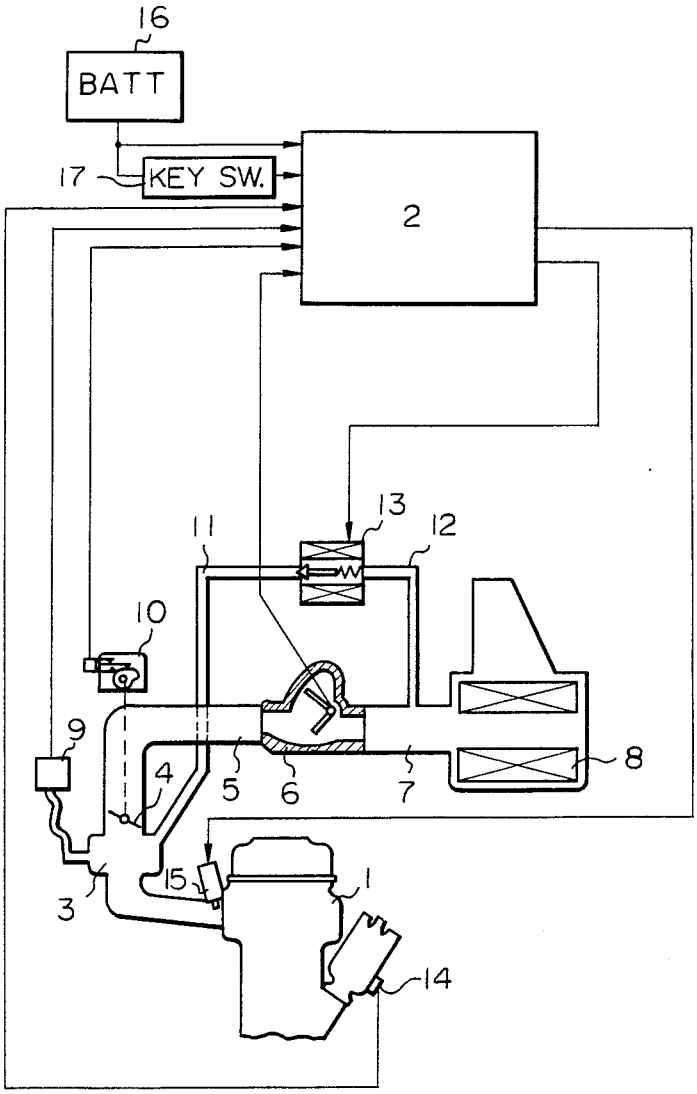
FIG. 1A illustrates an apparatus used for the method for controlling the air-fuel ratio in an internal combustion engine as an embodiment of the present invention.

An apparatus used for controlling the air-fuel ratio in an internal combustion engine as an embodiment of the present invention is illustrated in FIG. 1A. The apparatus of FIG. 1A comprises an internal combustion engine 1, a rotational angle sensor 14 incorporated with a distributor, an intake manifold 3, a throttle valve 4 actuated by an accelerator 10, and an air flow rate sensor 6. The type of air flow rate sensor 6 used is that which determines the flow rate of the air by measuring an output voltage corresponding to the angle of the obstructive plate located in the air flow path and changing the angle of the plate in accordance with air flow rate. The apparatus of FIG. 1A comprises also an air-transmitting down-stream duct 5 connecting the air flow rate sensor 6 with the throttle valve 4, an air cleaner 8, an air-transmitting up-stream duct 7 connecting the air cleaner 8 with the air flow rate sensor 6, a pressure sensor 9 for sensing air pressure, a throttle sensor 10 for detecting the fully-closed state and the more than 60% open state of the throttle valve 4, a solenoid valve 13 for regulating air flow through a route which forms the by-pass for the air flow rate sensor 6 and the throttle valve 4, a by-pass air-transmitting down-stream duct 11 connecting the solenoid valve 13 with the air intake manifold 3, a by-pass air transmitting up-stream duct 12 connecting the air-transmitting up-stream duct 7 with the solenoid valve 13, and a computer unit 2.

The solenoid valve 13 is an ON-OFF type which acts only in either the OPEN or CLOSED position. The computer unit receives signals from the air flow rate sensor 6, the rotational angle sensor 14, and the throttle sensor 10, calculates the amount of the fuel to be injected at the time in question, as a pulse width, and produces an output signal to be supplied to the fuel injection valve 15.

Figure 1B:
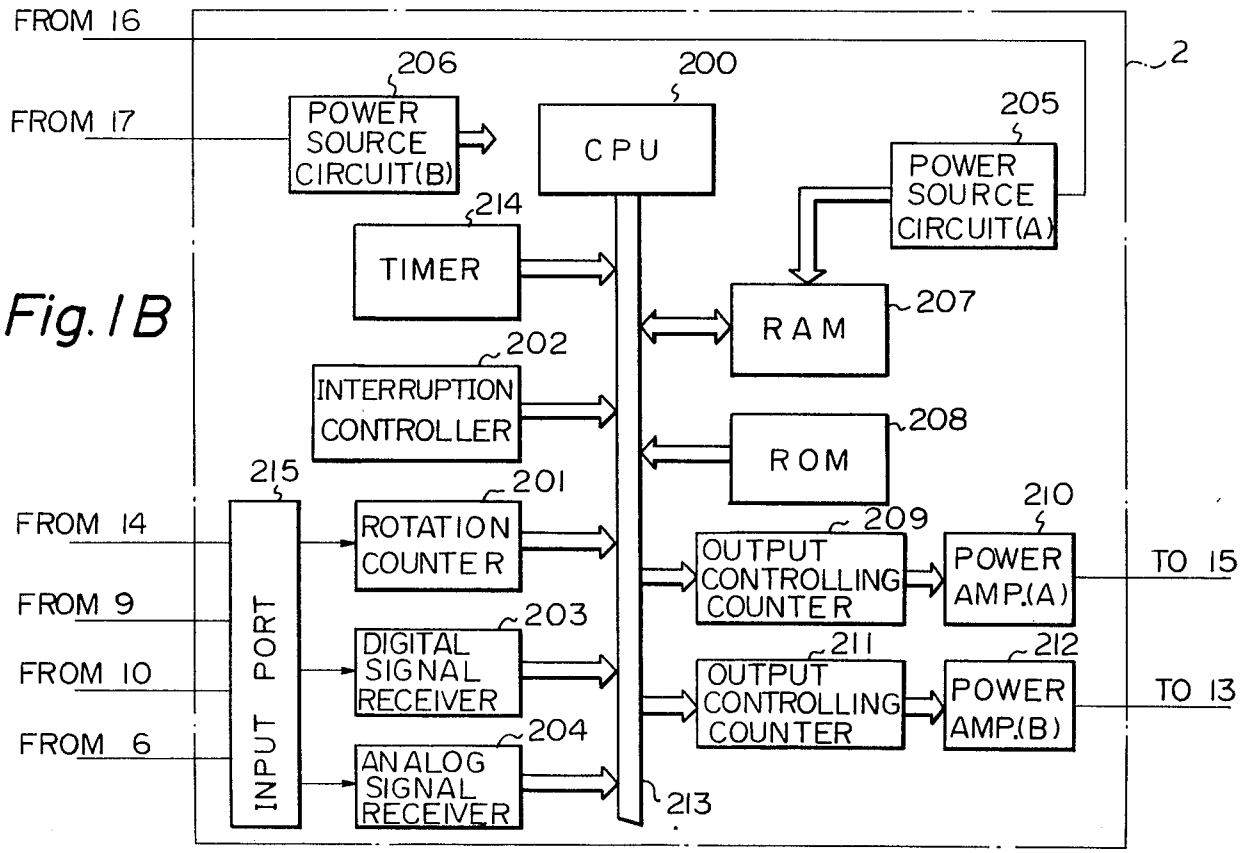
FIG. 1B illustrates the structure of the computer in the apparatus of FIG. 1A.

The structure of the computer unit 2 is illustrated in FIG. 1B. The computer unit 2 comprises a central processor unit (CPU) 200, a common bus 213, a timer 214, an interruption controlling portion 202, a rotation counter 201, a digital signal receiver 203, an analog signal receiver 204, an input port 215 receiving signals from the rotational angle sensor 14, the pressure sensor 9, the throttle sensor 10 and the air flow rate sensor 6, a random access memory 207, a read only memory 208, a counter 209 for controlling the timer for the fuel injection, a power amplifier (A) 210 for producing the signal for driving the fuel injection valve 15, an output control portion 211 for determining the signal for the solenoid valve 13 in the by-pass route 11 and 12, and a power amplifier (B) 212 for producing the signal for driving the solenoid valve 13. The power source circuits 205 and 206 receive power from the battery 16 and supply power to the random access memory 207 and other elements of the computer unit 2. The key switch 17 is provided between the battery 16 and the power source circuit 206.

Figure 2:
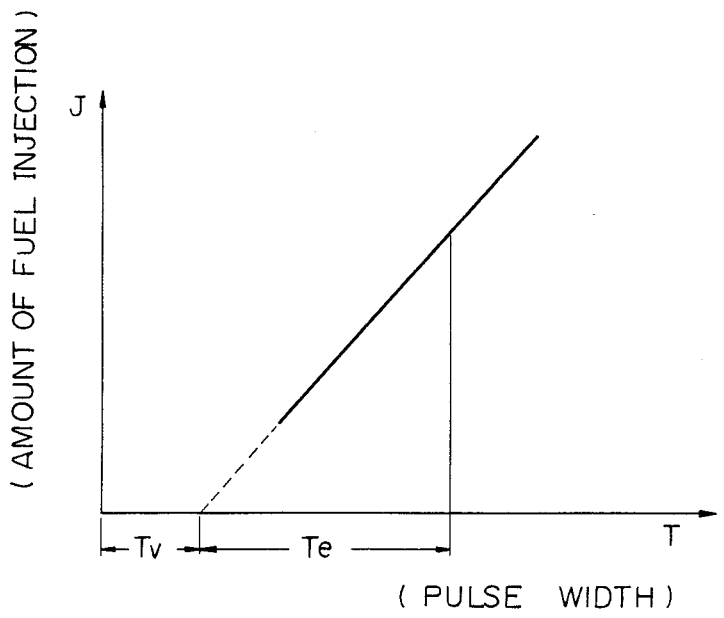
FIG. 2 illustrates the relationship between the pulse width and the amount of fuel injected.

The relationship between the pulse width T and the amount of the injected fuel J in the solenoid fuel injection valve 15, by which the fuel under a predetermined pressure is intermittently injected in accordance with the width of the applied pulse, is illustrated in FIG. 2. As the width T of the pulse produced from the computer 2 increases, the amount of the injected fuel increases linearly. $T_v$ is the pulse width corresponding to the delay time of the opening and the closing of the fuel injection. $T_e$ is the effective range of the width of the pulse for controlling the fuel injection valve 15.

Figure 3A:
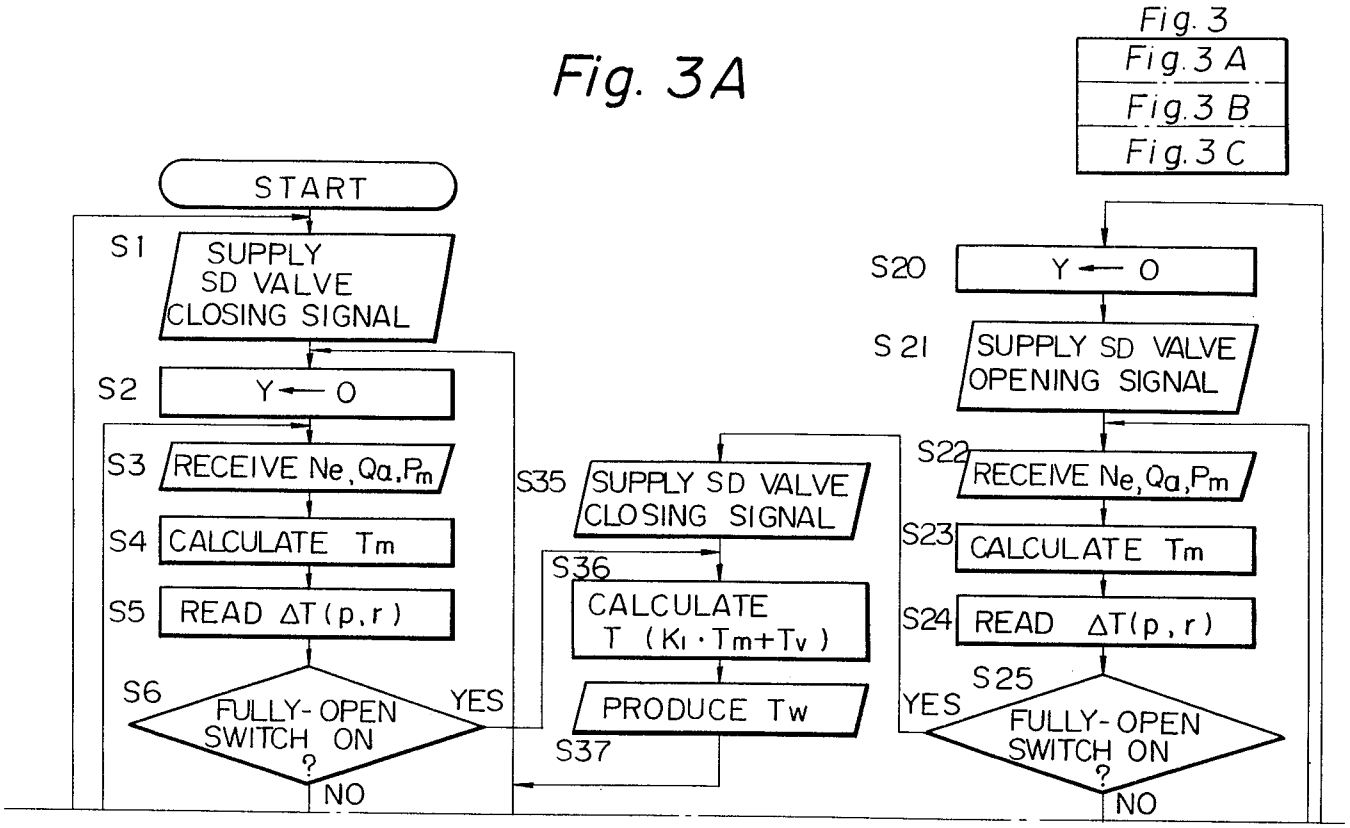
Figure 3B:
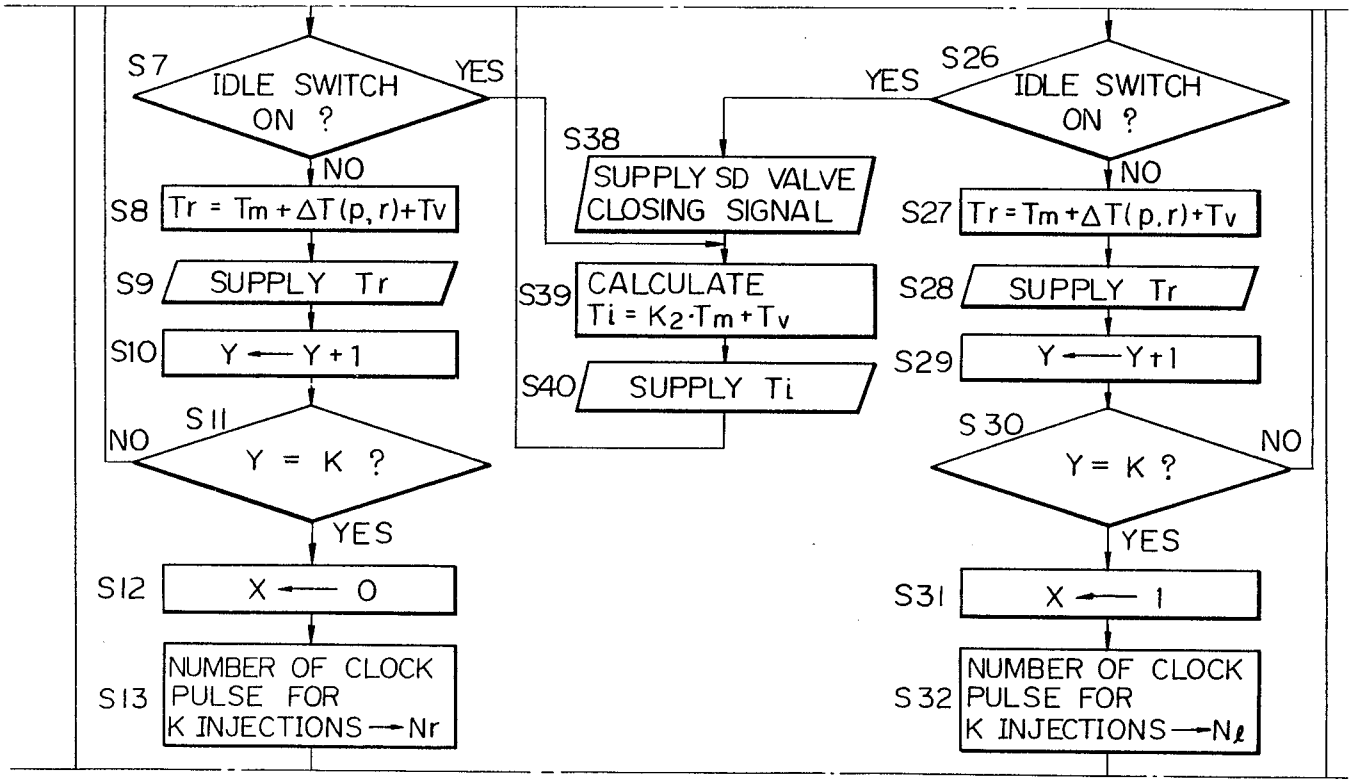
Figure 3C:
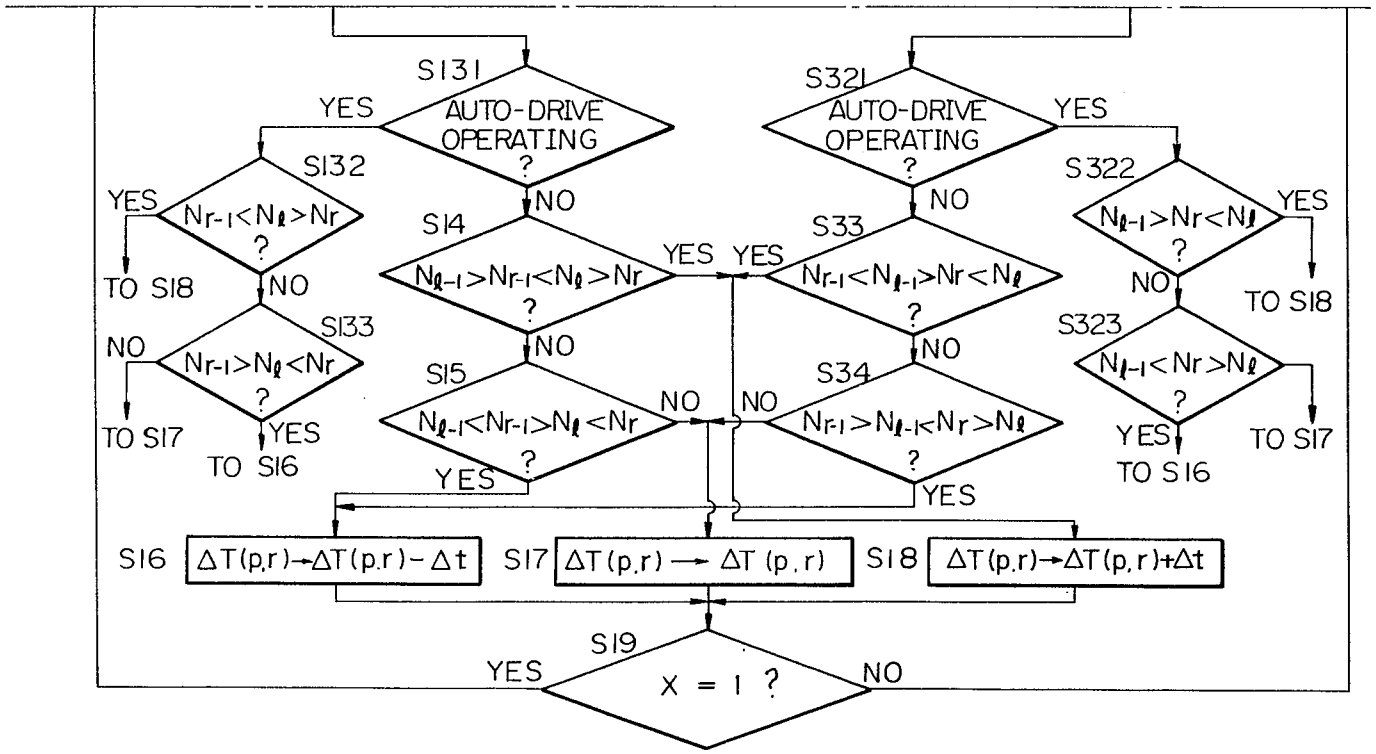

The flow chart of an example of the calculation process in the computer 2 is illustrated in FIGS. 3A, 3B, and 3C. When the engine 1 is started, the calculation process is started from step S1 in which the by-pass solenoid valve 13 is caused to be closed. In step S2, the initialization of the counter Y for counting the number of injections is carried out ($Y \leftarrow 0$). The injection occurs once per each rotation at a predetermined crank angle in a four-cylinder engine. The integrated number of rotations is obtained by counting the number of injections.

In step S3, the rotational speed $N_e$, the amount of the intake air $Q_a$, and the intake air pressure $P_m$ are introduced by the rotational angle sensor 14, the air flow rate sensor 6, and the air pressure sensor 9, respectively. In step S4, the calculation of the main pulse width, taking the stoichiometric air-fuel ratio ($A/F = 14.7$) as the base value, using the rotational speed $N_e$ and the amount of the intake air $Q_a$ is carried out. In step S5, the correction pulse width $\Delta T(p, r)$ corresponding to the present rotational speed $N_e$ and the present intake air pressure $P_m$ is read-out from the map, as illustrated in FIG. 4, stored in the memory. In the map illustrated in FIG. 4, the value of the rotational speed $N_e$ and the value of the intake air pressure $P_m$ are divided into sections with predetermined intervals, and a value of the correction pulse width $\Delta T(p, r)$ is assigned to each of the combinations of the values $N_e$ and $P_m$.

In step S6, the decision is made by the throttle sensor 10 as to whether or not the opening of the throttle valve is greater than 60%, i.e., whether or not the fully-open detection switch is ON. When the opening of throttle valve is greater than 60%, the process proceeds to step S36. In step S36, the main pulse width $T_m$ is multiplied by a correction coefficient $K_1$ to obtain the running air-fuel ratio (approximately equal to 13), and the delay time $T_v$ of the opening action of the fuel injection valve, as indicated in FIG. 2, is added to the product of the multiplication. Thus, when the opening of the throttle valve is greater than 60%, the pulse width is represented by the following equation.

$$T_w = K_1 \cdot T_m + T_v$$

In step S37, the signal of the pulse width $T_w$ is supplied to the fuel injection valve 15, and the process returns to step S2. Thus, when the opening of the throttle valve is greater than 60%, no decision and correction regarding the best specific fuel consumption air-fuel ratio is carried out.

In step S6, when the opening of the throttle valve is less than 60%, the decision is NO and the process proceeds to step S7. In step S7, the decision is made as to whether or not the angle of the throttle valve provides the fully-closed state, i.e., whether or not the idle switch is NO. When the throttle valve is fully-closed the decision is YES and the process proceeds to step S39. In step S39, the main pulse width $T_m$ calculated in step S4 is multiplied by a correction coefficient $K_2$, and the delay time $T_v$ is added to the product of the multiplication. Thus; when the engine is idling, the pulse width $T_i$ is represented by the following equation.

$$T_i = K_2 \cdot T_m + T_v$$

In step S40, the signal of the pulse width $T_i$ is supplied to the fuel injection valve 15, and the process returns to step S2. Thus, when the engine is idling, no decision and correction regarding the best specific fuel consumption air-fuel ratio is carried out, as when the opening of the throttle valve is greater than 60%.

In step S7, when the opening of the throttle valve is not in the idling state, the decision is NO, and the process proceeds to step S8. In step S8, the final pulse width $T_r$ is obtained by summing the main pulse width $T_m$, the correction pulse width $\Delta T(p, r)$, and $T_v$. In step S9, the signal of the pulse width $T_r$ is supplied to the fuel injection valve 15.

In step S10, the number Y of fuel injections is incremented by one. In step S11, the decision remains NO until the number Y is incremented up to a preselected value K, while the process is proceeding through the loop consisting of steps S3 through S11. In step S12, the number Y of fuel injections is made zero. In step S13, the counted number $N_r$ of the clock pulses for K times injections, i.e., the period of rotations for K times injections, is stored in the memory.

Figure 5:
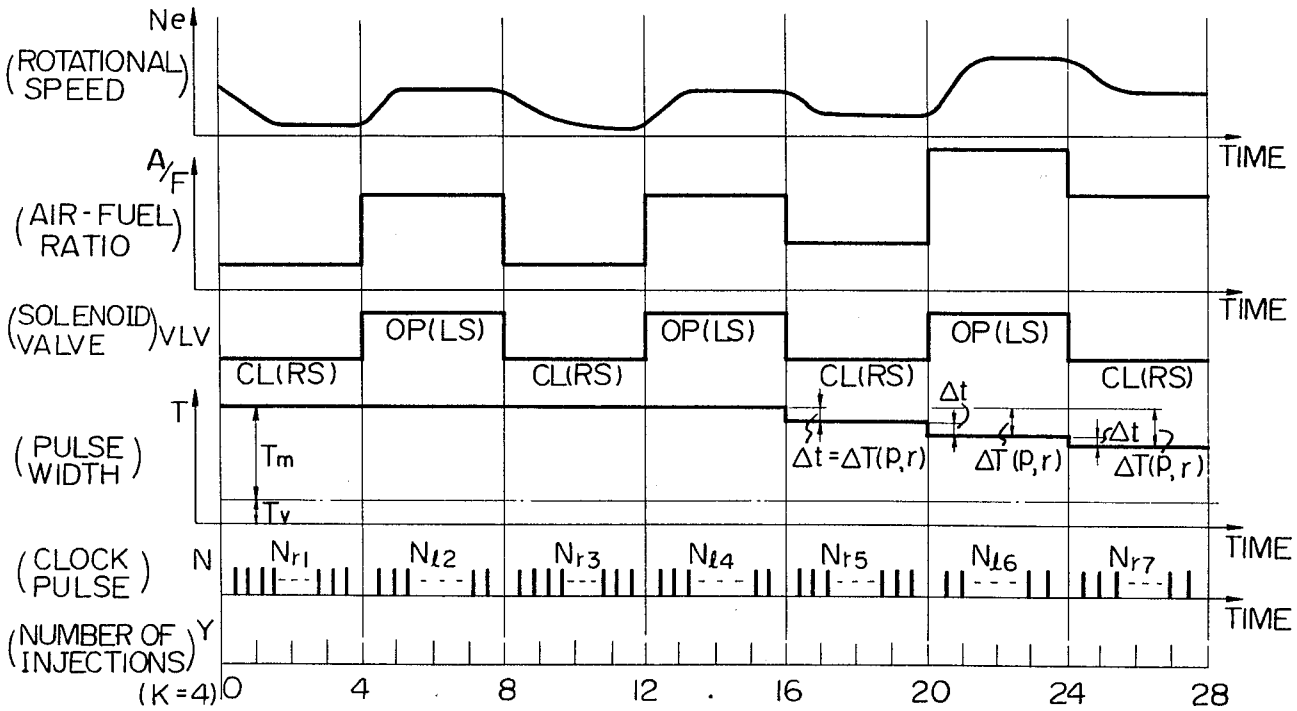
FIG. 5 illustrates a time chart of the change of signals in the process of the calculation conducted by the computer.

The change of signals in the above described process of the calculation is illustrated in the time chart of FIG. 5. In FIG. 5, the changes of the rotational speed $N_e$, the air-fuel ratio A/F, the state VLV of the by-pass solenoid valve, the pulse width, the clock pulses, and the number of fuel injections are illustrated. The process is in the rich period (RS) while the by-pass solenoid valve is closed (CL), and is in the lean period (LS) while the by-pass solenoid valve is open (OP). The number K of the fuel injection is preselected as four (K=4). The engine is operated with the by-pass solenoid valve closed, the number of the clock pulses being equal to $N_{r1}$.

Figure 6:
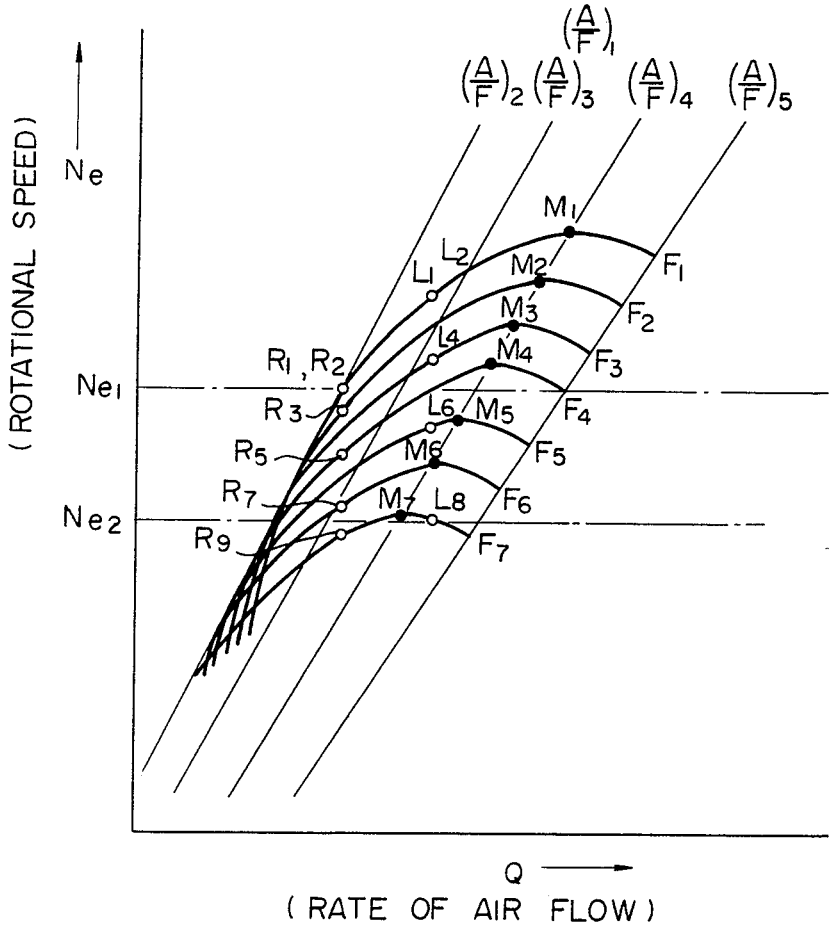
FIG. 6 illustrates a graph of the relationship between the rate of the air flow and the rotational speed using the air-fuel ratios and the rates of the fuel flow as the parameters.

The above described state of the operation of the engine corresponds to the position $R_1$ of the graph shown in FIG. 6, which illustrates the relationship between the rate Q of the air flow and the rotational speed $N_e$ of the engine when the axial torque of the engine is constant.

In FIG. 6, references $F_1$, $F_2$, $F_3$, $F_4$, $F_5$, $F_6$, and $F_7$ represent the rates of the fuel flow, where $F_1 > F_2 > F_3 > F_4 > F_5 > F_6 > F_7$. Each of the curves identified by $F_1$ through $F_7$ represents the change of $N_e$ in accordance with the change of Q under one of the values $F_1$ through $F_7$. $(A/F)_1$, $(A/F)_2$, $(A/F)_3$, $(A/F)_4$, and $(A/F)_5$ represents the air-fuel ratios. Each of the straight lines identified by $(A/F)_1$ through $(A/F)_5$ represents the change of $N_e$ in accordance with the change of Q under one of the values $(A/F)_1$ through $(A/F)_5$. Usually, the rotational speed becomes the maximum value when the air-fuel ratio is approximately equal to 13, where the flow rate of the air-fuel mixture is constant. In FIG. 6, $(A/F)_2$ is equal to 13. The positions $M_1$, $M_2$, $M_3$, $M_4$, $M_5$, $M_6$, and $M_7$, at which $N_e$ attain the maximum value in each of the curves identified by $F_1$ through $F_7$, are on the straight line identified by $(A/F)_4$. The specific fuel consumption becomes best at the positions $M_1$, $M_2$, $M_3$, $M_4$, $M_5$, $M_6$, and $M_7$ for each of the rates of the fuel flow $F_1$ through $F_7$. An object of the present invention is to conduct the automatic control for operating the engine at the positions $M_1$ through $M_7$.

For example, when the engine is running at the rotational speed $N_{el}$ and the initial state is at $R_1$ on the curve identified by $F_1$, running with the best specific fuel consumption is attained at the middle of $M_4$ and $M_5$, i.e., at the middle of the fuel flow rates $F_4$ and $F_5$.

In step S131, the decision is made whether or not the present control state is the automatic constant speed control state. This decision is made by detecting the "1" or "0" signal supplied from a controller for the automatic running speed control (not shown), and corresponds to the automatic constant speed control state or to the non-automatic speed control state. When the decision is NO, the process proceeds to step S14.

In steps S14 and S15, the four rotational periods $N_{l-1}$, $N_{r-1}$, $N_l$, and $N_r$, in which the present rich step rotational period $N_r$ is included, are compared with each other. $N_l$ is the preceding lean step rotational period, and $N_{r-1}$ is the next preceding rich step rotational period. $N_{l-1}$ is the further next preceding lean step rotational period.

When the existence of the relationship $N_{l-1} > N_{r-1} < N_l > N_r$ is acknowledged in step S14, the decision is YES, and the process proceeds to step S18. Here, if the rotational speed increases in the rich step and decreases in the lean step, the increase in the amount of fuel injected will cause the rotational speed and the specific fuel consumption to increase.

In steps S17 and S18, the calculation of the correction $\Delta T(p, r)$ of the pulse width is carried out. The correction pulse width $\Delta T(p, r)$ corresponding to the present rotational speed $N_e$ and the present intake air pressure $P_m$ is read out from the corresponding address of the map stored in the non-volatile memory in the computer, an increment $\Delta t$ is added to or subtracted from the read-out correction pulse width, and the thus added or subtracted correction pulse width is written in the corresponding address of the memory.

When the existence of the relationship $N_{l-1} > N_{r-1} < N_l > N_r$ is not decided in step S14, the process proceeds to step S15, i.e., where the engine is running in the richer air-fuel ratio than the best specific fuel consumption air-fuel ratio at one of the positions $M_1$ through $M_7$. Here, the existence of the relationship $N_{l-1}<N_{r-1}>N_l<N_r$ is decided in step S15, and the process proceeds to step S16. In step S16, the correction pulse width $\Delta T(p, r)$ corresponding to the state of the operation is subtracted by $\Delta t$, and the subtracted correction pulse width is stored in the memory. Thus, the amount of fuel injected is decreased by the amount corresponding to the pulse width t, so that the amount of fuel injected is brought to be close to the optimum amount.

When the existence of either the relationship $N_{l-1}>N_{r-1}<N_l>N_r$ or the relationship $N_{l-1}<N_{r-1}>N<N_r$ is not decided in steps S14 and S15, the process proceeds to step S17, where no amendement of $\Delta T(p, r)$ is carried out. For example, where, when the state of the operation of the engine changes in the transient period of the engine, e.g., when acceleration is caused by actuating the accelerator, the change of the rotational speed due to acceleration is far greater than the change of the rotational speed due to the change of the air-fuel ratio caused by slightly varying the air-flow rate in the rich and lean steps, and the rotational speed is increased gradually. Accordingly, the relationship $N_{l-1}>N_{r-1}>N_l>N_r$ is established, and hence, the decisions in steps S14 and S15 are NO and the process proceeds to step S17. Also, when the air-fuel ratio is equal to the best specific fuel consumption air-fuel ratio, the relationship $N_{l-1}=N_{r-1}=N_l=N_r$ is established and no amendment of the correction of the pulse width is carried out, so that the best specific fuel consumption air-fuel ratio tends to be maintained.

When the decision in step S131 is YES, the process proceeds to step S132. In step S132, the decision is made whether or not the relationship $N_{r-1}<N_l>N_r$ exists. When the decision in step S132 is YES, the process proceeds to step S18, while when the decision is NO, the process proceeds to step S133. In step S133, the decision is made whether or not the relationship $N_{r-1}>N_l<N_r$ exists is carried out. When the decision in step S133 ie YES, the process proceeds to step S16, while when the decision is NO, the process proceeds to step S17.

After steps S16, S17, and S18, the process proceeds to step S19. In step S19, the decision is made as to whether the present step is the rich step (X=0) or the lean step (X=1). If it is the rich step (X=0), the decision is NO, and the process proceeds to step S20, while if it is the lean step (X=1), the decision is YES, and the process proceeds to step S1. When the process has proceeded from step S1 through step S13 as described above, the decision is NO, and the process proceeds to step S20. In step S20, the number Y of injections is made zero. Here, as the process is in the lean step, the by-pass solenoid valve is made OPEN.

In steps S22 through S24, similar calculations are made as in steps S3 through S5. In step S25, the decision is made whether or not the opening of the throttle valve is greater than 60%. When the opening of the throttle valve is greater than 60%, the decision is YES, and the process proceeds to step S35 where the by-pass solenoid valve 13 is closed. In step S36, the calculation of the pulse width for the running air-fuel ratio is carried out, and the adjustment to the optimum specific fuel consumption air-fuel ratio is interrupted. In step S37, the signal with the calculated pulse width is supplied to the fuel injection valve 15. The process then proceeds to step S2, and the entire process is repeated from the beginning.

When the decision in step S25 is NO, the process proceeds to step S26. In step S26, the decision is made whether or not the throttle valve is fully-closed. If this valve is fully-closed, the decision is YES, and the process proceeds to step S38. In step S38, the by-pass solenoid valve 13 is closed, as for step S35. In step S39, the calculation of the pulse width for the idling air-fuel ratio is carried out. In step S40, the signal with the calculated pulse width is supplied to the fuel injection valve 15. The process then proceeds to step S2, and the entire process is repeated from the beginning.

When the decision in step S26 is NO, the process proceeds to step S27. In steps S27 through S29, similar calculations are made as in steps S8 through S10. In step S30, the decision is made whether or not the number Y of the injections reaches the preselected number K. When the preselected number K is not reached, the decision is NO, and the process proceeds through the loop consisting of steps S22 through S30.

When the number Y of injections reaches K, the decision in step S30 is YES, and the process proceeds to step S31. In step S31, the value of X is made one, to memorize the condition of the present step, i.e., in the lean step. In step S32, the rotational period $N_l$ of the lean step is stored in the memory as for step S13.

In step S321, the decision is made whether or not the present control state is the automatic constant speed control state. When the decision is NO, the process proceeds to step S33.

When the existence of the relationship $N_{r-1}<N_{l-1}15>N_r<N_l$ is decided in step S33, the process proceeds to S18, as for S14. In step S18, the amendment $\Delta t$ is added to the correction pulse width $\Delta T(p, r)$, and the amended correction pulse width is stored in the memory. When the existence of the relationship $N_{r-1}<N_{l-1}>N_r<N_l$ is not decided in step S33, the process proceeds to step S34. The decision as to whether or not the relationship $N_{r-1}>N_{l-1}<N_r>N_l$ is carried out in step S34. When the existence of this relationship is decided in step S34, the process proceeds to step S16 where the amendment $\Delta t$ is subtracted from the correction pulse width $\Delta T(p, r)$ and the amended correction pulse width is stored in the memory. When the existence of this relationship is not decided in step S34, the process proceeds to step S17 and no amendment is made of the correction pulse width $\Delta T(p, r)$.

When the decision in step S321 is YES, the process proceeds to step S322. In step S322, the decision is made whether or not the relationship $N_{l-1}>N_r<N_l$ exists. When the decision in step S322 is YES, the process proceeds to step S18, while when the decision is NO, the process proceeds to step S323. In step S323, the decision is made whether or not the relationship $N_{l-1}<N>N_l$ exists. When the decision in step S323 is YES, the process proceeds to step S16, while when the decision is NO, the process proceeds to step S17.

After steps S16, S17, and S18, the process proceeds to step S19 where the decision is made whether or not the present step is the lean step. Here, steps S20 through S32 are lean steps (X=1), the decision is YES, and the process proceeds to step S1.

In accordance with the above-described control of the engine, if the air-fuel ratio is different from an air-fuel ratio corresponding to the best specific fuel consumption, the air-fuel ratio is corrected so that an air-fuel ratio corresponding to the best specific fuel consumption is attained. Also, it is possible to control the engine so that the optimum running condition are always realized, because the optimum correction valve $\Delta T(p, r)$ corresponding to each state of the running of the engine is stored in the memory of the computer.

The relationship between the above-described calculation process and the driving of the automobile in which the internal combustion engine in question is mounted will be explained with reference to FIG. 6. The movement of the operation position is started at $R_1$ of the rich step. The operation position moves from $R_1$ of the rich step to $L_1$ of the lean step, along the curve identified by $F_1$. The position corresponding to the best specific fuel consumption on the curve identified by $F_1$ is $M_1$. The operation position moves from $L_1$ to $R_2$, then from $R_2$ to $L_2$. After the operation position has reached $L_2$, the existence of the relationship $N(R_1)>N(L_1)<N(R_2)>N(L_2)$ is decided in step S34, and hence, the subtraction of the correction pulse width by $\Delta t$ is carried out in step S16. Accordingly, the rate of the fuel flow is decreased so that the operation position moves from the curve $F_1$ to the position $R_3$ on the curve $F_2$, where the value $F_2$ is smaller than the value $F_1$. After the operation at the position $R_3$, the existence of the relationship $N(L_1)<N(R_2)>N(L_2)<N(R_3)$ is decided in step S15, and accordingly, the operation position moves from the curve $F_2$ to the curve $F_3$, where the value $F_3$ is smaller than the value $F_2$. Such movements of the operation position to the next curve take place successively until the operation position reaches $L_8$, where the relationship $N(R_5)>N(L_6)<N(R_7)>N(L_8)$ is established so that there is no further movement of operation position.

Thus, the state of the running of the engine is led to the point $L_8$, which is quite close to the point $M_7$ corresponding to the best specific fuel consumption with a constant fuel flow rate of $F_7$. However, since at the beginning the driver requires the rotational speed $N_{e1}$, the driver must become aware of the fall in the rotational speed from $N_{e1}$ to $N_{e2}$. When becoming aware of this fall, the driver will actuate the accelerator to raise the rotational speed to $N_{e1}$, so that the rate of the fuel flow becomes an intermediate value between $F_4$ and $F_5$.

In the apparatus of FIG. 1, the air-flow rate through the bypass solenoid valve 13 is selected so that both the drivability of the automobile in which the internal combustion engine is mounted and the detection of the change of the rotational speed of the engine are satisfactory. The amendment value $\Delta t$ of the correction of the amount of fuel injected is selected to be less than a half the change of the air-fuel ratio caused by the action of the by-pass solenoid valve 13.

Although a specific embodiment of the present invention is described hereinbefore, various modifications are possible. For example, a set of decision conditions:

$N_{l-1}>N_{r-1}$, $N_l>N_r$ in step S14,
$N_{l-1}<N_{r-1}$, $N_l<N_r$ in step S15,
$N_{r-1}<N_{l-1}$, $N_r<N_l$ in step S33, and
$N_{r-1}>N_{l-1}$, $N_r>N_l$ in step S34 can be adopted in the flow chart of FIG. 3.

Also, instead of the ON-OFF type solenoid valve 13, a variable area type solenoid valve having the valve lift regulated by an electric current signal can be used, whereby the air-flow rate through the by-pass solenoid valve is controlled to be equal to a predetermined proportion of the air-flow rate through the air-flow rate sensor 6.

In the process of the flow chart shown in FIGS. 3A to 3C, when the number of operation points for detecting the signals of the running state is increased, a precise separation can be attained between the engine rotational speed change caused by constant altering of the air-fuel ratio and that caused externally by, for example, the accelerator pedal actuation by the driver, changes in road conditions, and the like.

The automatic constant speed control is used, in general, for running on roads in good condition, such as a high-speed highway, in which the running speed remains fairly constant as there are few changes in the road conditions. Hence, a precise feedback for realizing an air-fuel ratio giving the best specific fuel consumption can be attained, even if the number of operation points for detecting the signals of the running state is less than that for the normal running state. Also, it is possible to increase the opportunities for correcting the air-fuel ratio, to reduce the time needed for reaching the base air-fuel ratio, and to lower the specific fuel consumption minimum.

Although the preferred embodiment of the present invention has been described hereinbefore, various modifications and alterations are possible without departing from the scope of the present invention. For example, the numbers of operation points for detecting the signals of the running states in the non-automatic speed control state and in the automatic constant speed control state can be selected as different from the above-described embodiment, in which the number is four for the non-automatic state and three for the automatic state, provided that a condition is maintained wherein the number for the non-automatic state is greater than the number for the automatic state.

It is also possible to alter the selection of the lengths of the constant altering period for the non-automatic state and for the automatic state, to prevent deterioration of the drivability of the automobile during the automatic state, instead of the above-described embodiment in which the lengths of such constant altering periods are selected to be the same.

Further, it is possible to realize a modified embodiment of the present invention wherein, by using two by-pass solenoid valves, three air-fuel ratio levels are prepared, i.e., first level: no by-pass (RICH step (RS)), second level: one by-pass solenoid valve ON (BASIC step (BS)), and third level: two by-pass solenoid valves ON (LEAN step (LS)). The running process of the engine then changes in the following manner: $B_1 \rightarrow R_1 \rightarrow B_3 \rightarrow L_4 \rightarrow B_5 \rightarrow R_6 \rightarrow B_7$; when the relationships $N(B_1)$, $N(B_3)>N(R_2)$ and $N(B_3)$, $N(B_5)<N(L_4)$ are established in five running points, the addition of the correction pulse width $\Delta T(p, r)$ by the value $\Delta t$ is carried out, while, when the relationships $N(B_1)$, $N(B_3)<N(R_2)$ and $N(B_3)$, $N(B_5)>N(L_4)$ are established in five running points, the subtraction of the correction pulse width $\Delta T(p, r)$ by the value $\Delta t$ is carried out.

We claim:

1. A method for controlling the air-fuel ratio in an internal combustion engine for a vehicle operable in either of an automatic constant speed control state and a non-automatic speed control state in which speed of said vehicle is controlled, respectively, to be constant or varied as commanded by an operator of said vehicle, said method comprising the steps of:

changing the amount of air supplied through a by-pass air supply path which by-passes the main air supply path to realize at least two different values of the air-fuel ratio in the vicinity of a base air-fuel ratio;

running the engine with said realized different values of the air-fuel ratio;

detecting at plural operation points the signals of parameters of the engine running state, including at least one of engine rotational speed and engine torque, under the running of the engine with said realized different values of the air-fuel ratio;

deciding whether the base air-fuel ratio is in the rich or in the lean side of the air-fuel ratio for optimum specific fuel consumption by comparing said signals detected at said plural operation points; and correcting the air-fuel ratio on the basis of the result of said decision;

a different number of operation points for detecting said signals of said parameters of the engine running state being selected for said automatic constant speed control state and for said non-automatic speed control state.

2. A method as in claim 1, wherein said number of operation points selected during said automatic constant speed control state is three, and said number of operation points selected during said non-automatic speed control state is four.

3. A method as in claim 1, wherein said number of operation points which are selected during said non-automatic state is maintained greater than said number of operation points which are selected during said automatic state.

4. An apparatus for controlling the air-fuel ratio in an internal combustion engine of a vehicle operable in either of an automatic constant speed control state and a non-automatic speed control state in which speed of said vehicle is controlled, respectively to be constant or varied as commanded by an operator, said apparatus comprising:

a throttle valve;

a fuel injection valve;

a main air path and a by-pass thereof;

means for varying the air fuel ratio of said engine by varying the amount of fuel injected by said fuel injection valve;

sensor means for detecting signals representing parameters of the running state of said engine;

means for regulating the rate of air flow in said by-pass for said main air path of said engine, said by-pass supplying an air flow to a point downstream of said throttle valve;

means for switching said engine running state between said automatic constant speed control state and said non-automatic speed control state; and computer means for receiving signals from said sensors, controlling selection of said air-fuel ratio at the rich and the lean side of the base air-fuel ratio, comparing signals representing richer and leaner engine running states, determining the state of the air-fuel ratio, and producing signals which are used for regulating said amount of fuel injection and said rate of air flow in said by-pass for said main air path; wherein said computer means includes means for selecting a different number of operation points for detecting signals representing parameters of said engine running state during said automatic constant speed control state than during said non-automatic speed control state.

5. An apparatus according to claim 4, wherein said sensor means includes a rotational angle sensor, an air flow rate sensor, a pressure sensor, and a throttle sensor.

6. An apparatus according to claim 4, wherein said means for regulating said air-fuel ratio includes a valve for fuel injection, an air flow rate sensor having a by-pass and a solenoid valve arranged in said by-pass for said air flow rate sensor.

7. A method for controlling the air-fuel ratio in an internal combustion engine of a vehicle operable under an automatic constant speed control state and a non-automatic speed control state in which a vehicle speed in controlled to a constant speed and to a varying speed as commanded by an operator, respectively, said method comprising the steps of:

periodically changing the air-fuel ratio of mixture supplied to said engine to realize at least two different values of the air-fuel ratio in the vicinity of a base air-fuel ratio;

running the engine with said realized different values of the air-fuel ratio;

detecting at plural operation points the signals of the parameters of the engine running state, including at least one of engine rotational speed and engine torque, under the running of the engine with said realized different values of the air-fuel ratio;

deciding whether the base air-fuel ratio is in the rich or in the lean side of the air-fuel ratio for optimum specific fuel consumption by comparing said signals detected at the plural operation points;

correcting the air-fuel ratio on the basis of the result of said decision; and selecting a first number and a second number of operation points for detecting the signals of the parameters of the engine running state during the automatic constant speed control state and during the non-automatic speed control state, respectively, said first number being smaller than said second number.

8. An apparatus for controlling the air-fuel ratio in an internal combustion engine of a vehicle operable under an automatic constant speed control state and a non-automatic speed control state in which speed of said vehicle is controlled to a constant speed and to a varying speed as commanded by an operator, respectively, said apparatus comprising:

means for periodically changing the air-fuel ratio of a mixture supplied to said engine to realize at least two different values of the air-fuel ratio in the vicinity of a base air-fuel ratio;

means for running said engine with said realized different values of said air-fuel ratio;

detecting at plural operation points the signals of parameters of an engine running state, including at least one of engine rotational speed and engine torque, under the running of said engine with said realized different values of said air-fuel ratio;

means for deciding whether the base air-fuel ratio is in the rich or in the lean side of the air-fuel ratio for optimum specific fuel consumption by comparing said signals detected at said plural operation points, and for outputting the same;

means for correcting said air-fuel ratio in accordance with said output of said means for deciding and;

means for selecting a first number and a second number for operation points for detecting the signals of said parameters of said engine running state for said automatic constant speed control state and for said non-automatic speed control state, respectively, and for maintaining said first number smaller than said second number.

* * * * *